US007192105B2

(12) United States Patent
Jung

(10) Patent No.: US 7,192,105 B2
(45) Date of Patent: Mar. 20, 2007

(54) DOOR CONTROL DEVICE FOR REFRIGERATORS AND REFRIGERATOR WITH THE DEVICE

(75) Inventor: Tae Hwan Jung, Daequ Metropolitan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 285 days.

(21) Appl. No.: 10/646,863

(22) Filed: Aug. 25, 2003

(65) Prior Publication Data

US 2005/0212392 A1 Sep. 29, 2005

(30) Foreign Application Priority Data

Jan. 21, 2003 (KR) ..... 10-2003-0004131

(51) Int. Cl.
*A47B 96/04* (2006.01)

(52) U.S. Cl. ..... 312/405

(58) Field of Classification Search ..... 312/405, 312/326, 329, 319.2, 319.1, 319.4; 16/334, 16/332, 331, 86 C
See application file for complete search history.

(56) References Cited

U.S. PATENT DOCUMENTS 2,074,008 A * 3/1937 Wolf ..... 16/84
2,268,977 A * 1/1942 Westrope ..... 16/86 C
3,980,331 A * 9/1976 Kennedy et al. ..... 292/268
4,833,755 A * 5/1989 Bonin ..... 16/344
5,220,747 A * 6/1993 Cherry et al. ..... 49/386
5,706,551 A * 1/1998 Jeynes et al. ..... 16/59
5,896,619 A * 4/1999 Koopman ..... 16/50
5,931,554 A * 8/1999 Koopman ..... 312/405
6,370,732 B1 * 4/2002 Yezersky et al. ..... 16/85
6,640,387 B2 * 11/2003 Alonso ..... 16/72
6,711,778 B2 * 3/2004 Sparkman ..... 16/86 C

FOREIGN PATENT DOCUMENTS

EP 0807737 * 11/1997
KR 20-0281220 6/2002
KR 10-2004-0021444 10/2004

OTHER PUBLICATIONS

Inventor: Heung Kee, Kim et al.; Publication No. 1020020040537; Publication Date: May 30, 2002; Title: Door Hinge Unit.

* cited by examiner

*Primary Examiner*—Janet M. Wilkens
*Assistant Examiner*—Timothy M. Ayres
(74) *Attorney, Agent, or Firm*—Staas & Halsey LLP

(57) ABSTRACT

A door control device for refrigerators and a refrigerator with the device. The door control device for a refrigerator having a refrigerator door includes a movable body coupled to the refrigerator door, wherein the movable body is arranged to move in opposite directions in accordance with opening and closing actions of the refrigerator door, and a control unit controlling an opposite directional movement of the movable body in a multi-stage manner.

47 Claims, 4 Drawing Sheets

DOOR CONTROL DEVICE FOR REFRIGERATORS AND REFRIGERATOR WITH THE DEVICE

CROSS-REFERENCE TO RELATED APPLICATIONS

This application claims the benefit of Korean Patent Application No. 2003-4131, filed Jan. 21, 2003, in the Korean Intellectual Property Office, the disclosure of which is incorporated herein by reference.

BACKGROUND OF THE INVENTION

1. Field of the Invention

The present invention relates, in general, to a door control device for refrigerators, and a refrigerator with such a device. More particularly, the present invention relates to a door control device for refrigerators which controls the open angle of a refrigerator door as a user desires, maintains the selected open angle of the door, and dampens a door closing action to retard the energy generated from the door closure. The present invention also relates to a refrigerator having such a door control device.

2. Description of the Related Art

As is well known to those skilled in the art, refrigerators are domestic appliances which keep food and drink cool, for a desired lengthy period of time, while maintaining the freshness of the food and drink. A refrigerator typically comprises a freezer compartment and a refrigerator compartment, with a door provided on each compartment to close the compartment.

Refrigerators are typically arranged side by side with other kitchen furniture or appliances, such as a kitchen sink or a microwave oven. A large-sized refrigerator may be installed in a specified recess formed in a kitchen wall. Due to such an arrangement of the refrigerators, there sometimes occurs interference between the doors of a refrigerator and neighboring furniture, appliances, or the kitchen wall. As a result, the refrigerator doors are easily damaged and are inconvenient for users while opening or closing the doors.

In an effort to solve such problems, the inventors of the present invention proposed a door control device for allowing a user to control the maximum open angles of refrigerator doors, as disclosed in Korean Patent Application No. 2002-53288. However, the conventional door control device is problematic in that a user is forced to loosen and tighten bolts to adjust the maximum open angles of refrigerator doors, making the device inconvenient for the users. In addition, the device only allows a user to adjust the maximum open angles of refrigerator doors, so it is difficult to control the open angles of the refrigerator doors as users desire, or to maintain the selected open angles of the refrigerator doors.

SUMMARY OF THE INVENTION

Accordingly, it is an aspect of the present invention to provide a door control device for refrigerators, which controls the open angle of a refrigerator door as a user desires, maintains the selected open angle of the door, and dampens a door closing action to retard the energy generated from the door closure. It is another aspect of the present invention to provide a refrigerator having the door control device.

Additional aspects and advantages of the invention will be set forth in part in the description which follows and, in part, will be obvious from the description, or may be learned by practice of the invention.

The foregoing and/or other aspects of the present invention are achieved by providing a door control device for a refrigerator having a refrigerator door, including a movable body coupled to the refrigerator door, wherein the movable body is arranged to move in opposite directions in accordance with opening and closing actions of the refrigerator door, and a control unit controlling an opposite directional movement of the movable body in a multi-stage manner.

Also, a guide element contains the movable body, in order to guide the opposite directional movement of the movable body.

Also, a link bar is hinged at a first end thereof to an end of the movable body, and is connected at a second end thereof to the refrigerator door.

Also, the link bar is hinged to the refrigerator door.

Also, the movable body is provided with a plurality of grooves formed along a longitudinal side surface thereof.

The foregoing and/or other aspects of the present invention are also achieved by providing a door control device for a refrigerator having a refrigerator door, including a movable body coupled to the refrigerator door, wherein the movable body is arranged to move in opposite directions in accordance with opening and closing actions of the refrigerator door, and a dampening unit dampening a rearward movement of the movable body during a door closing action, thus retarding energy generated from door closure.

BRIEF DESCRIPTION OF THE DRAWINGS

These and/or other aspects and advantages of the invention will become apparent and more readily appreciated from the following description of preferred embodiments, taken in conjunction with the accompanying drawings of which.

DETAILED DESCRIPTION OF THE PREFERRED EMBODIMENTS

Figure 1:
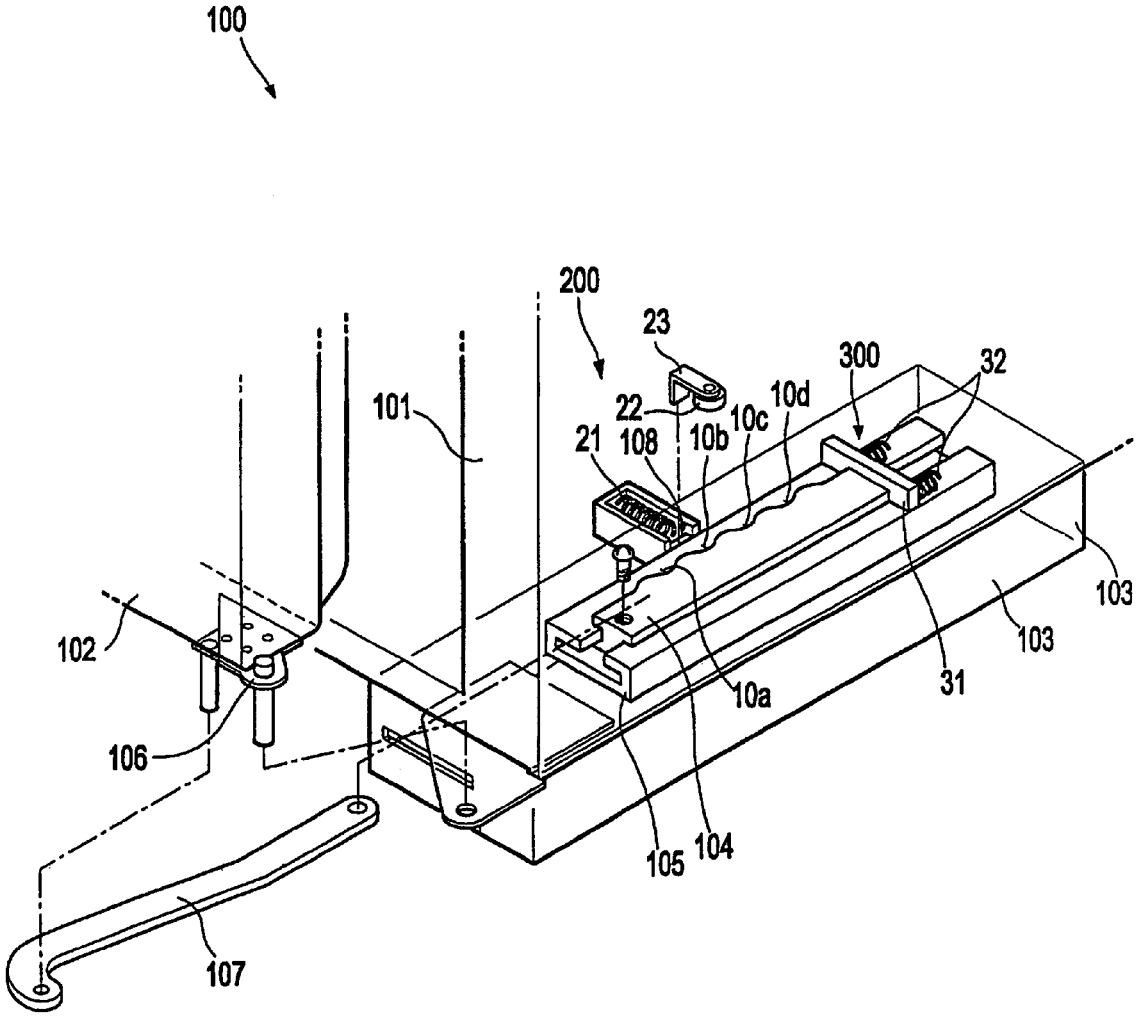
FIG. 1 is an exploded perspective view of a part of a refrigerator having a door control device, according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
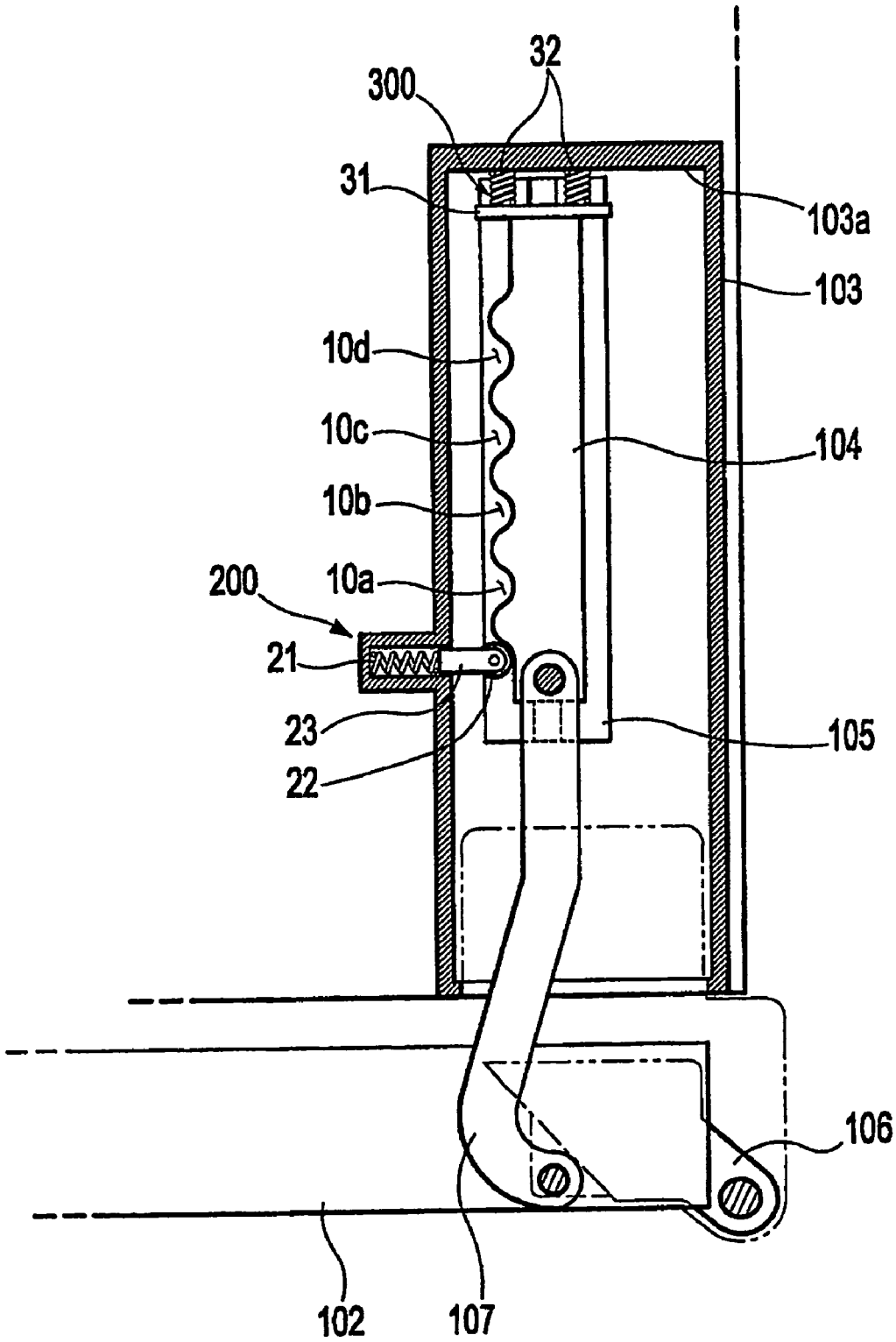
FIG. 2 is a top view of the part of the refrigerator having the door control device of the present invention.
Figure 3:
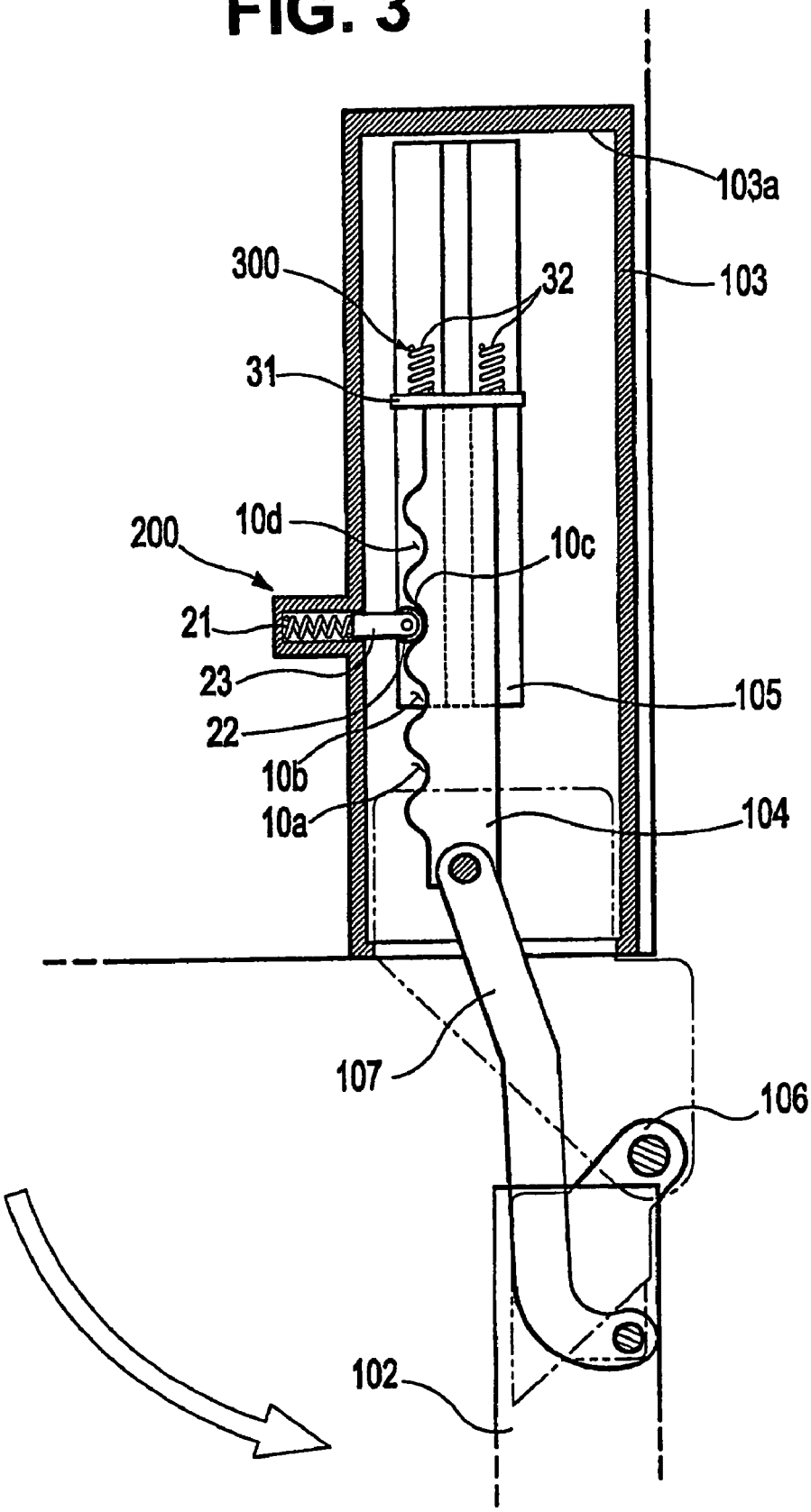
FIG. 3 is a top view of the part of the refrigerator having the door control device of the present invention, and showing the operation of the door control device of the present invention.
Figure 4:
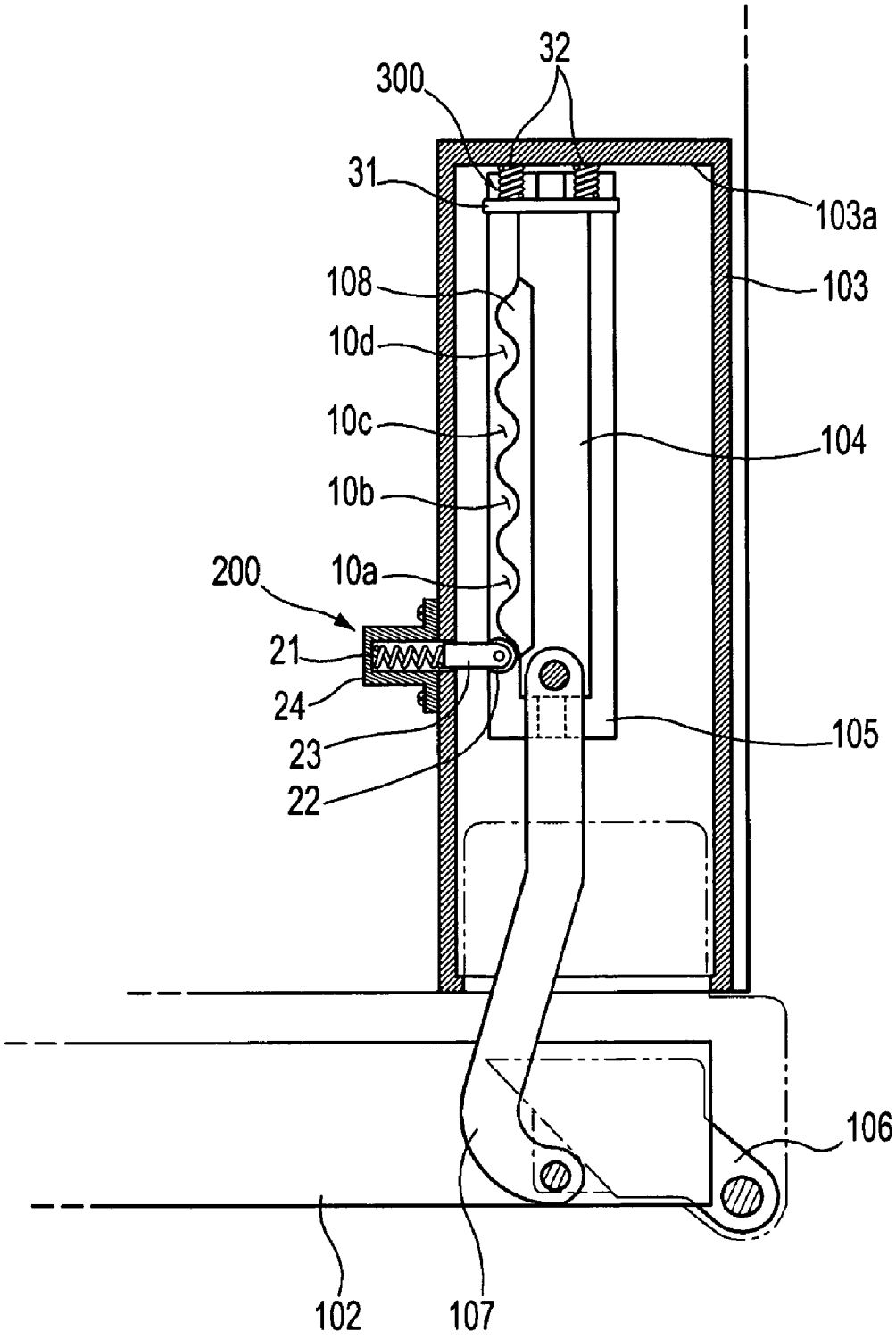
FIG. 4 is a top view of the part of the refrigerator having the door control device according to another embodiment of the present invention.

FIG. 1 is an exploded perspective view of a part of a refrigerator having a door control device according to an embodiment of the present invention. FIG. 2 is a top view of the part of the refrigerator having the door control device. FIG. 3 is a top view of the part of the refrigerator having the door control device, showing the operation of the door control device of the present invention. FIG. 4 is a top view of the part of the refrigerator having the door control device according to another embodiment of the present invention.

As shown in FIGS. 1 and 2, the door control device according to the present invention is used with a refrigerator 100. The refrigerator 100 having the door control device is configured as follows.

The refrigerator 100 comprises a cabinet 101 with storage compartments, typically a freezer compartment and a refrigerator compartment, with doors 102 hinged to the cabinet 101 to close the respective storage compartments. For ease of description, only one door 102 is shown in the drawings. The refrigerator 100 also has a door control device according to the present invention. The door control device includes a leg casing 103 which is installed in a lower portion of the cabinet 101. A longitudinal movable bar 104 is axially arranged in the leg casing 103 such that the bar 104 is axially moved under the guide of a channeled rail 105 in opposite directions. A longitudinal side surface of the movable bar 104 is uneven, with four grooves 10*a*, 10*b*, 10*c* and 10*d* formed along the uneven surface of the bar 104 at regular intervals. The channeled guide rail 105 is axially installed in the leg casing 103 to hold the movable bar 104 and to guide any axial movement of the bar 104. A hinge bracket 106 is mounted to the door 102. A curved link bar 107 is hinged at a first end thereof to an end of the movable bar 104, and at a second end thereof to the hinge bracket 106 at a position spaced apart from a rotating axis of the door 102 by a predetermined distance in a radial direction from the rotating axis. A control chamber 108 is perpendicularly defined at a sidewall of the leg casing 103, and a control unit 200 is installed in the control chamber 108 so as to control the axial movement of the bar 104 in a multi-stage manner. A dampening unit 300 is installed in the leg casing 103 at a position behind the rear end of the movable bar 104, so that the dampening unit 300 dampens a rearward moving action of the movable bar 104 during the door closure. The dampening unit 300 thus dampens the door closing action, and retards the energy generated from the door closure.

The control unit 200 comprises a retractable locking unit and a first spring 21. The first spring 21 is axially arranged in the control chamber 108, and the retractable locking unit comprises a roller 22 and a roller bracket 23. The roller bracket 23 is elastically supported at a first end thereof by the first spring 21, and rotatably holds the roller 22 at a second end thereof. The roller 22 is thus perpendicularly placed relative to the movable bar 104, and is elastically retractable, so that the roller 22 is sequentially seated into the four grooves 10*a*, 10*b*, 10*c* and 10*d* while rolling on the uneven surface of the movable bar during an axial movement of the movable bar 104 in the leg casing 103.

The uneven surface of the movable bar 104, having the four grooves 10*a*, 10*b*, 10*c* and 10*d*, is smoothly curved to form a waved configuration, so that the roller 22 rolls on the uneven surface of the bar 104 while being sequentially seated into the four grooves 10*a*, 10*b*, 10*c* and 10*d* in response to an axial movement of the movable bar 104.

The dampening unit 300 is an elastic support unit which elastically supports the rear end of the movable bar 104. That is, the dampening unit 300 includes a support member designed as an end plate 31, and an elastic member comprised of two second springs 32. The end plate 31 is mounted to the rear end of the movable bar 104, and the second springs 32 are connected to the end plate 31 at two positions while being arranged in parallel, so that the second springs 32 are brought into contact with a rear end wall of the leg casing 103 during a door closing action.

The operational effect of the refrigerator having the door control device of the present invention will be described herein below, with reference to FIG. 3.

When a user (not shown) rotates the door 102 in a direction as shown by the arrow of FIG. 3 to open the door 102 to a desired open angle, the link bar 107, hinged to the hinge bracket 106 of the door 102, is pulled toward the front of the refrigerator 100, so that the movable bar 104, hinged at a front end thereof to the rear end of the link bar 107, is axially moved toward the front of the refrigerator 100. During the forward movement of the movable bar 104, the roller 22 rolls on the uneven surface of the bar 104. In such a case, the uneven surface of the movable bar 104 has the four curved grooves 10*a*, 10*b*, 10*c* and 10*d*, so that the roller 22, held by the roller bracket 23 and elastically biased by the first spring 21, perpendicularly advances and retracts repeatedly, relative to the uneven surface of the movable bar 104, during the forward movement of the bar 104.

When the user opens the door 102 to a desired open angle, for example, 90° as shown in FIG. 3, the roller 22 rolls on the uneven surface of the forward moving bar 104, while repeatedly advancing and retracting relative to the uneven surface of the bar 104, until the roller 22 is seated into the third groove 10*c*, which corresponds to the desired open angle of 90°. When the door 102 is opened to reach the desired open angle of 90°, the user releases his/her handling force from the door 102, so that the roller 22 of the roller bracket 23, biased by the first spring 21, is somewhat strongly pushed into the third groove 10*c* corresponding to the open angle of 90°. The roller 22 is thus maintained at the position thereof inside the third groove 10*c*, and the door 102 is maintained at the open position of the open angle of 90°. That is, the control unit 200, including the roller 22, stops the axial movement of the movable bar 104, and allows the door 102 to be maintained at its open state of the open angle of 90°. Even though external force, such as weight of the door 102, is applied to the door 102 on which the user does not impose his/her physical force, the control unit 200 prevents an undesired axial movement of the movable bar 104. The open angle of the door 102 is thus not changed, but the open door 102 is maintained at its open state at the desired open angle.

FIG. 3 shows the door 102, which is maintained at its open state, at an open angle of about 90°. However, it should be understood that the open angle of the door 102 may be controlled by the variable position of the roller 22 relative to the four grooves 10*a*, 10*b*, 10*c* and 10*d* of the movable bar 104, and the door 102 is maintained at a desired open angle determined by the roller seated in either of the four grooves 10*a*, 10*b*, 10*c* and 10*d*.

When the user closes the open door 102, the second springs 32 are brought into contact with the rear end wall 103*a* of the leg casing 103, and elastically support the movable bar 104 moving backward in the leg casing 103 during the door closing action. Therefore, the second springs 32 dampen the door closing action, thus reducing the door closing speed and retarding the energy generated from the door closure. The door 102 is thus smoothly and gently closed without applying impact energy to the refrigerator.

In an embodiment of the present invention, the movable bar has four grooves to change the open angle of the door between four angles. However, it should be understood that the number of grooves formed on the movable bar may be changed to five or more grooves, or three or less grooves, in order to change the number of open angles of the door which may be selected by a user, as desired. In addition, the grooves for seating the roller of the control unit may be formed on a separate member mounted to a side surface of the movable bar, as illustrated in FIG. 4.

The control chamber which receives the first spring of the control unit may be integrally formed on the sidewall of the leg casing by outwardly depressing the sidewall, as shown in the drawings. Alternatively, the control chamber may be defined in a separate member which is provided at a predetermined position around the sidewall of the leg casing, as illustrated in FIG. 4.

In addition, the end plate and the second springs may be provided on the inner surface of the rear end wall of the leg casing, in place of the rear end of the movable bar. Alternatively, the end plate and the second springs may not be mounted to the inner surface of the rear end wall of the leg casing or the rear end of the movable bar, but arranged between the rear end wall of the leg casing and the rear end of the movable bar.

As is apparent from the above description, the present invention provides a door control device for refrigerators, which allows a user to easily control the open angle of a refrigerator door as desired without forcing the user to perform additional work to control the open angle of the door. The door control device also maintains a selected open angle of the door, and dampens a door closing action to retard the energy generated from the door closure. The door control device thus prevents interference between the refrigerator doors and neighboring furniture, appliances or kitchen wall, and is convenient for users of refrigerators. The door control device also prevents rapid door closure.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator having a refrigerator door and a door control device for the refrigerator, comprising:

a movable body coupled to the refrigerator door, wherein the movable body is arranged to move in opposite directions in accordance with opening and closing actions of the refrigerator door; and a control unit controlling an opposite directional movement of the movable body in a multi-stage manner such that the refrigerator door is maintained at a selected one of a plurality of predetermined positions between a closed position and a fully open position, wherein the movable body with an I-shaped cross section is provided with a plurality of grooves formed along a longitudinal upper side surface thereof, a lower portion of the movable body is slidably inserted into a C-shaped channeled guide rail and movable there along a longitudinal axis of the rail.

2. The door control device according to claim 1, further comprising a guide element containing the movable body and guiding the opposite directional movement of the movable body.

3. The door control device according to claim 1, further comprising a link bar hinged at a first end thereof to an end of the movable body, and connected at a second end thereof to the refrigerator door.

4. The door control device according to claim 3, wherein the link bar is hinged to the refrigerator door.

5. The door control device according to claim 4, wherein the link bar is further hinged to the refrigerator door in a position spaced apart from the rotating axis of the refrigerator door by a predetermined distance in a radial direction from the rotating axis.

6. The door control device according to claim 1, wherein the control unit comprises a locking unit selectively engaging with the plurality of grooves provided to the movable body.

7. The door control device according to claim 6, wherein the control unit further comprises an elastic member elastically supporting the locking unit.

8. The door control device according to claim 7, wherein the locking unit comprises a retractable roller selectively seated in the grooves of the movable body during a movement of the movable body.

9. The door control device according to claim 8, wherein the locking unit further comprises a roller bracket elastically supported at a first end thereof by the elastic member, and rotatably holding the roller at a second end thereof.

10. The door control device according to claim 9, wherein the roller is perpendicularly placed relative to the movable body, and wherein the roller is elastically retractable.

11. The door control device according to claim 1, wherein the grooves of the movable body are smoothly curved to form a waved configuration.

12. The door control device according to claim 1, wherein the device is disposed in a leg casing at a lower portion of the refrigerator.

13. The door control device according to claim 12, wherein the control unit is disposed in a control chamber that is perpendicularly defined at a sidewall of the leg casing.

14. The door control device according to claim 13, wherein the control chamber is integrally formed on a sidewall of the leg casing by outwardly depressing the sidewall.

15. The door control device according to claim 13, wherein the control chamber is defined in a separate member provided at a predetermined position on a sidewall of the leg casing.

16. A refrigerator having a refrigerator door and a door control device for the refrigerator, comprising:

a movable body coupled to the refrigerator door, wherein the movable body is arranged to move along a longitudinal axis in opposite directions in accordance with opening and closing actions of the refrigerator door, wherein the movable body is provided with a plurality of grooves formed along a longitudinal side surface thereof;

a control unit to control an opposite directional movement of the movable body in a multi-stage manner such that the refrigerator door is maintained at a selected one of a plurality of predetermined positions between a closed position and a fully open position, wherein the control unit comprises a locking unit selectively engaging with the plurality of grooves provided to the movable body and an elastic member elastically supporting the locking unit; and a dampening unit dampening a rearward movement of the movable body during the closing action, thus retarding energy generated from the refrigerator door closing, wherein the dampening unit comprises an elastic support unit elastically supporting a rear end of the movable body.

17. The door control device according to claim 16, wherein the elastic support unit comprises a support member supporting the rear end of the movable body, and further comprises an elastic member provided at a rear end of the support member.

18. The door control device according to claim 17, wherein the elastic member is connected to the rear end of the support member.

19. The door control device according to claim 17, wherein the support member is mounted to the rear end of the movable body.

20. The door control device according to claim 17, wherein the elastic member comprises one or more compression springs.

21. The door control device according to claim 17, wherein the elastic member is two or more compression springs arranged in parallel.

22. The door control device according to claim 17, wherein the support unit is disposed in a leg casing at a lower portion of the refrigerator.

23. The door control device according to claim 22, wherein the support unit is disposed on an inner surface of the rear end wall of the leg casing.

24. The door control device according to claim 22, wherein the support unit is disposed between the rear end wall of the leg casing and the rear end of the movable body.

25. A refrigerator, comprising:

a cabinet with a storage compartment;

a door hinged to the cabinet to close the storage compartment;

a leg casing installed in a lower portion of the cabinet;

a movable body coupled to door, wherein the movable body is arranged in the leg casing so as to move in opposite directions in the leg casing; and a control unit to control an opposite directional movement of the movable body in a multi-stage manner such that the refrigerator door is maintained at a selected one of a plurality of predetermined positions between a closed position and a fully open position, wherein the movable body with an I-shaped cross section is provided with a plurality of grooves formed along a longitudinal upper side surface thereof, a lower portion of the movable body is slidably inserted into a C-shaped channeled guide rail and movable there along a longitudinal axis of the rail.

26. The refrigerator according to claim 25, further comprising a guide element installed in the leg casing to contain the movable body and to guide the opposite directional movement of the movable body.

27. The refrigerator according to claim 25, further comprising a link bar hinged at a first end thereof to an end of the movable body, and connected at a second end thereof to the door.

28. The refrigerator according to claim 27, wherein the link bar is hinged to the door.

29. The refrigerator according to claim 28, further comprising a hinge bracket mounted to the door, wherein the link bar is connected to the hinge bracket.

30. The refrigerator according to claim 28, wherein the link bar is hinged to the door in a position spaced apart from the rotating axis of the door by a predetermined distance in a radial direction from the rotating axis.

31. The refrigerator according to claim 25, wherein the control unit comprises a locking unit selectively engaging with the plurality of grooves provided to the movable body.

32. The refrigerator according to claim 31, wherein the control unit further comprises an elastic member elastically supporting the locking unit.

33. The refrigerator according to claim 32, wherein the locking unit comprises a retractable roller selectively seated into the grooves of the movable body during a movement of the movable body.

34. The refrigerator according to claim 33, wherein the locking unit further comprises a roller bracket elastically supported at a first end thereof by the elastic member, and rotatably holding the roller at a second end thereof.

35. The refrigerator according to claim 34, wherein the roller is perpendicularly placed relative to the movable body, and the roller is elastically retractable.

36. The refrigerator according to claim 25, wherein the grooves of the movable body are curved to form a waved configuration.

37. The refrigerator according to claim 25, further comprising a control chamber perpendicularly defined at a sidewall of the leg casing, wherein the control unit is disposed in the control chamber.

38. The refrigerator according to claim 37, wherein the control chamber is integrally formed on a sidewall of the leg casing by outwardly depressing the sidewall.

39. The refrigerator according to claim 37, wherein the control chamber is defined in a separate member provided at a predetermined position on a sidewall of the leg casing.

40. A refrigerator, comprising:

a cabinet with a storage compartment;

a door hinged to the cabinet to close the storage compartment;

a leg casing installed in a lower portion of the cabinet;

a movable body coupled to the door, wherein the movable body is arranged in the leg casing so as to move along a longitudinal axis in opposite directions in the leg casing in accordance with door opening and door closing actions, wherein the movable body is provided with a plurality of grooves formed along a longitudinal side surface thereof;

a control unit to control an opposite directional movement of the movable body in a multi-stage manner such that the refrigerator door is maintained at a selected one of a plurality of predetermined positions between a closed position and a fully open position, wherein the control unit comprises a locking unit selectively engaging with the plurality of grooves provided to the movable body and an elastic member elastically supporting the locking unit; and a dampening unit provided in said leg casing to dampen a rearward movement of the movable body during a door closing action, thus retarding energy generated from the door closure, wherein the dampening unit comprises an elastic support unit elastically supporting a rear end of the movable body.

41. The refrigerator according to claim 40, wherein the elastic support unit comprises a support member supporting the rear end of the movable body, and further comprises an elastic member provided at a rear end of the support member.

42. The refrigerator according to claim 41, wherein the support member is mounted to the rear end of the movable body.

43. The refrigerator according to claim 41, wherein the elastic member is connected to the rear end of the support member.

44. The refrigerator according to claim 41, wherein the elastic member comprises one or more compression springs.

45. The refrigerator according to claim 41, wherein the elastic member is two or more compression springs arranged in parallel.

46. The refrigerator according to claim 41, wherein the support unit is disposed on an inner surface of the rear end wall of the leg casing.

47. The refrigerator according to claim 41, wherein the support unit is disposed between the rear end wall of the leg casing and the rear end of the movable body.

* * * * *